US008505640B2

(12) United States Patent
Hagar et al.

(10) Patent No.: US 8,505,640 B2
(45) Date of Patent: Aug. 13, 2013

(54) APPARATUS FOR FIREFIGHTING

(76) Inventors: W. Michael Hagar, Monroe, VA (US); Donna G. Moser, High Point, NC (US)

( * ) Notice: Subject to any disclaimer, the term of this patent is extended or adjusted under 35 U.S.C. 154(b) by 1121 days.

(21) Appl. No.: 11/681,504

(22) Filed: Mar. 2, 2007

(65) Prior Publication Data

US 2007/0251707 A1 Nov. 1, 2007

Related U.S. Application Data

(62) Division of application No. 11/681,494.

(60) Provisional application No. 60/778,423, filed on Mar. 3, 2006, provisional application No. 60/844,679, filed on Sep. 15, 2006.

(51) Int. Cl.
*A62C 13/00* (2006.01)

(52) U.S. Cl.
USPC ..... 169/30; 169/71; 169/77; 169/85; 239/308; 239/337; 252/2; 252/8; 252/601; 252/605

(58) Field of Classification Search
USPC ..... 169/30, 44–47, 71, 77, 85; 239/303, 239/308, 337, 338; 252/2–8.05, 601–611
See application file for complete search history.

(56) References Cited

U.S. PATENT DOCUMENTS

| | | | | |
|---|---|---|---|---|
| 3,252,902 | A * | 5/1966 | Mevel | 169/45 |
| 5,169,037 | A | 12/1992 | Davies et al. | |
| 5,585,028 | A * | 12/1996 | Berger | 252/2 |
| 5,660,763 | A * | 8/1997 | Uhlig | 252/606 |
| 6,394,188 | B1 * | 5/2002 | Zwergel | 169/85 |
| 6,422,320 | B1 * | 7/2002 | Mather et al. | 169/88 |
| 2007/0289752 | A1 * | 12/2007 | Beck et al. | 169/47 |

* cited by examiner

*Primary Examiner* — Jason Boeckmann
(74) *Attorney, Agent, or Firm* — Whitham, Curtis, Christofferson & Cook, P.C.

(57) ABSTRACT

A combination of a liquid fire extinguishing composition including potassium salts or aluminum salts of an organic acid, resulting in a viscous liquid, is finely divided by a nozzle into droplets which may be applied to a fire or fuel therefor or form a cloud of droplets which settle onto such fire and/or fuel which is particularly effective for fighting fires where fuel is at least initially contained such as oil and grease fires in cooling utensils being heated on stoves. Propellant is contained and not entrained in the dispensed fire fighting composition to avoid at least spreading of the fuel beyond the containment.

15 Claims, 2 Drawing Sheets

© 2006, Blue Ridge Concepts, Inc.

APPARATUS FOR FIREFIGHTING

CROSS-REFERENCE TO RELATED APPLICATIONS

This application claims priority of U.S. Provisional Applications 60/778,423, filed Mar. 3, 2006, and 60/844,679, filed Sep. 15, 2006, both of which provisional applications are hereby fully incorporated by reference as if fully set forth herein. This application is also a division of U.S. Utility patent application Ser. No. 11/681,494, filed concurrently herewith.

BACKGROUND OF THE INVENTION

1. Field of the Invention

The present invention generally relates to fire fighting apparatus, methods, apparatus and compositions and, more particularly, to methods, apparatus and compositions for fighting fires or explosions where the fuel for the fire or explosion is, at least initially closely confined such as fires in kitchens involving cooking oils, fats and other combustible food materials or household appliances and furnishings.

2. Description of the Prior Art

Numerous fires occur annually which involve the preparation of food or other operations on materials which are combustible at temperatures which can be easily reached during such operations. Cooking oils and fats are a common source of such fires since they may become self-igniting at temperatures below that of the sources of heat closely adjacent thereto during food preparation. Fires in cooking utensils are particularly dangerous and potentially destructive since they can be easily spread by the application of water or other relatively reflexive but generally ill-considered initial efforts to fight such fires and often result in the ignition of clothing of the person initially attempting to extinguish the fire. Such fires, particularly in non-commercial kitchens usually cause unusually expensive damage due to the proximity to expensive cooking appliances, cabinetry, and building structures and expensive finished surfaces.

Numerous inventions have been made for fire extinguishing apparatus and compositions and several articles have been published in regard to fighting such fires and application of extinguishants thereto as summarized in the above-incorporated U.S. Provisional Patent Applications. Nevertheless, such approaches to fighting fires as are disclosed therein have not proven particularly effective for fire of this and similar types.

SUMMARY OF THE INVENTION

It is therefore an object of the present invention to provide a self-contained portable apparatus or fixed installation for extinguishing fires fed by fuels that are at least initially confined or contained and which provides for effective and safe application of extinguishants of compositions thereto which are effective for fighting such fires.

In order to accomplish these and other objects of the invention, and apparatus and method of fighting a fire wherein fuel feeding said fire is initially confined within an area by providing for spraying droplets of a liquid fire extinguishing composition on an area exceeding the area in which fuel is confined from a range of two to two and one-half feet or forming a distribution of droplets of said liquid fire extinguishing composition which is substantially stationary in a horizontal direction in an area exceeding said area to which said fuel is confined; the liquid fire extinguishing composition comprising having a viscosity substantially determined by at least 20% v/v of one or more potassium salts or aluminum salts of an organic acid or a combination of potassium or aluminum and an organic acid and further including an efficacious amount of IXF to enhance fire extinction or function as a wetting agent and wherein the fire extinguishing composition comprises approximately one of:

| | |
|---|---|
| Water | 20.2% |
| Lactic Acid | 27.89% |
| Potassium Hydroxide 45% Liq. | 33.69% |
| Potassium Carbonate 47% Liq. | 7.37% |
| Potassium Bicarbonate | 3.93% |
| Intermediate IXF | 6.93% |
| and | |
| Potassium Lactate (60% conc.) | 61.0% |
| Potassium Carbonate (47% conc.) | 7.6% |
| Potassium Bicarbonate (20% conc.) | 21.5% |
| Intermediate IXF | 6.7%, |
| and Additional water | 3.2%. |

BRIEF DESCRIPTION OF THE DRAWINGS

The foregoing and other objects, aspects and advantages will be better understood from the following detailed description of a preferred embodiment of the invention with reference to the drawings, in which:

FIG. 1 illustrates a hand-held portable apparatus which may be used for fighting kitchen fires and the like.

FIG. 1A schematically illustrates a preferred nozzle spray pattern which is particularly effective for practice of the invention, FIG. 2 provides a scaled plan view of a preferred pattern of directed mist of liquid extinguishant distributed by, for example, the portable, hand held device of FIG. 1 or a fixed installation performing essentially the same function.

DETAILED DESCRIPTION OF A PREFERRED EMBODIMENT OF THE INVENTION

Figure 1:
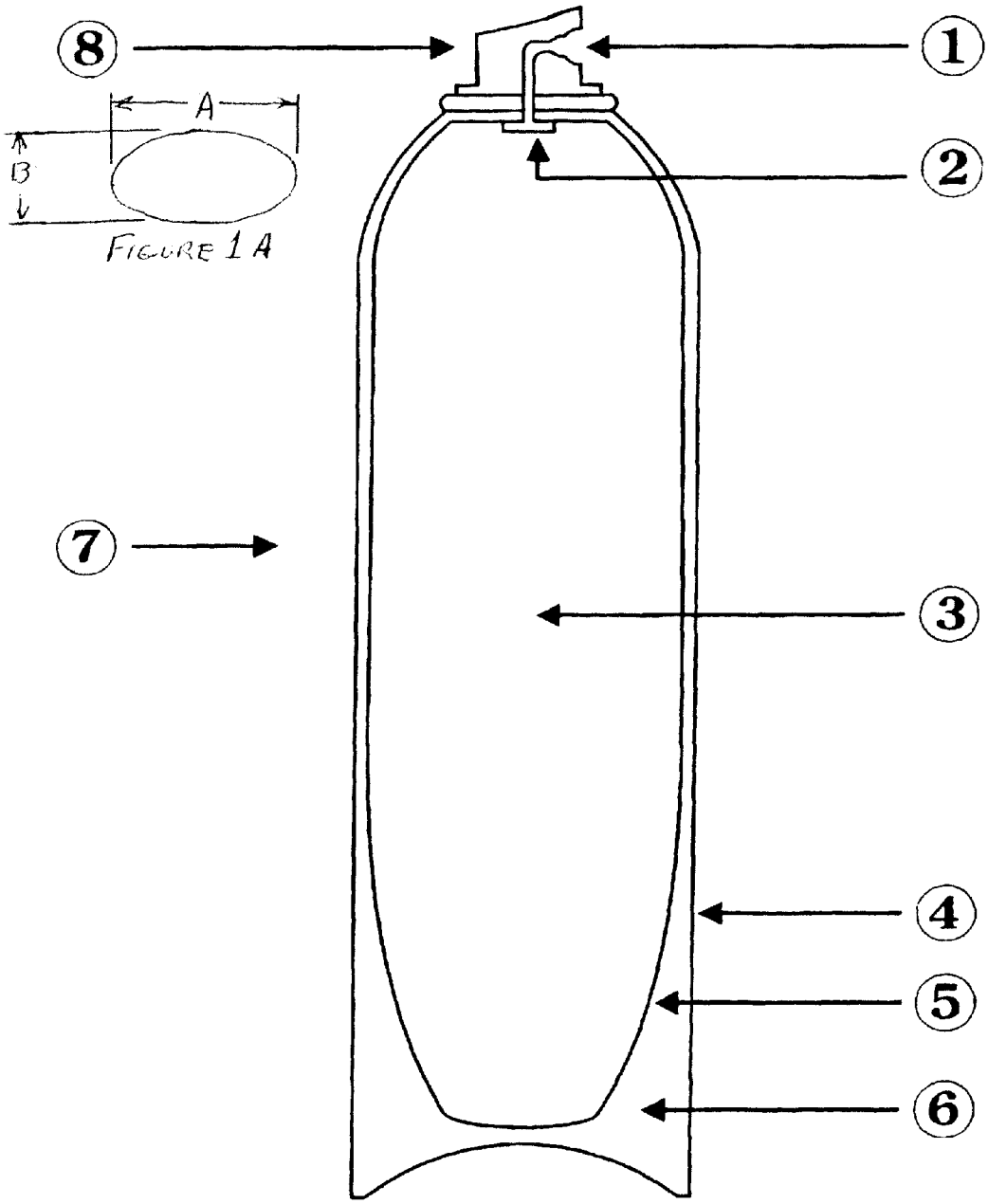

Referring now to the drawings, and more particularly to FIG. 1, there is shown a hand-held, portable version of an apparatus 7 which may be employed as an embodiment of the apparatus contemplated for use in the practice of the method in accordance with the present invention. The hand-held apparatus 7 includes a hollow, substantially rigid outer body 4 which exhibits sufficient strength and heat resistance. It is preferred that the rigid outer body be fabricated principally from Aluminum but other materials can be such as steel, metal alloys and the like, including plastics and resin-based materials. Disposed within the outer body 4 is an elastic, flexible, inner bladder 5 which, in turn, contains a given volume of a pre-mixed loaded-water liquid or fire fighting or extinguishing composition 3. A charge of gaseous propellant 6 is contained in the ullage which exists between the rigid outer body 4 and the inner bladder 5. The liquid extinguishant is maintained in a liquid state under all storage conditions permissible for apparatus 7 which range from about −35°Celsius to just below 100°Celsius.

A dispensing valve 2 is situated at the outlet of the flexible inner bladder 5 and in communication with the liquid extinguishant 3 such that application of force upon an actuator 8 located outside the rigid outer body 4 causes the liquid extinguishant 3, devoid of gaseous propellant 6, to be forced through nozzle 1, while the charge of gaseous propellant 6 remains at all times contained within the outer body 4. Nozzle 1 acts to divide liquid extinguishant 3 into a mist of finely-divided droplets and to disseminate this mist in a direction away from apparatus 7. Those skilled in the art will recognize that such a construction allows the omission of a so-called dip tube while allowing the apparatus 7 to provide a mist of droplets while in any orientation of the apparatus 7 that might be required for self-protection of the user from a fire and removes a degree of criticality from the use of the invention that might otherwise result in the loss of time in fighting the fire before it can spread or develop secondary fires.

Inner bladder 5 (and, correspondingly, rigid outer body 4) should be sized to hold a suitable volume of liquid extinguishant 3 In the preferred (e.g. hand-held) embodiment, inner bladder 5 is sized to hold a volume of fourteen fluid ounces (552.72 milliliters but volumes ranging from 200 to 1000 milliliters have experimentally proven both practical and advantageous in different circumstances. Larger volumes may be preferred for fixed installations (such as in combination with a so-called range hood or ventilation arrangement over a work surface or heat source) where weight and the ability to manipulate the apparatus with, for example, one hand are not an issue but may not be necessary in view of the effectiveness of the apparatus as will described in further detail below.

Gaseous propellant 6 is preferably atmospheric air at a pressure of about 120 psig but other propellants such as carbon dioxide, nitrogen and argon may also be used and may be present at pressures ranging from 40 psig to 200 psig. It is considered to be an important feature of the invention that gaseous propellant 6 is never released or discharged to the atmosphere and is not mixed with the liquid extinguishant as the latter is released. This feature of the present invention, while not strictly necessary for its successful practice, allow recharging of the apparatus 7 without having to recharge the gaseous propellant and also appears to enhance effectiveness of the discharged extinguishant as will be described in greater detail below as well as reducing the risk of spreading burning or high-temperature fuel or excess movement of the flame column, either of which may ignite secondary fires or increase physiological dangers of suffocation and/or freezing due to inhaling of or contact with propellant since there is no propellant entrained in the extinguishant. This structure also allows a separate valve for pressurizing the propellant to be omitted (the propellant can be pressurized before sealing the outer body with the inner, flexible bladder 5), reducing total cost of apparatus 7.

The selection and design of nozzle 1 is important to the effectiveness of the preferred, portable, hand-held spray can embodiment of the apparatus 7 in accordance with the invention and, in the preferred embodiment, is selected as a carefully crafted shaft or bore having an internal transverse dimension between 0.016 and 0.055 inches, and preferably having an outlet which is oval or elliptical as shown in FIG. 1A. Several factors should be considered in determining nozzle dimensions. In general, smaller transverse dimensions of the nozzle results in a smaller droplet size of the extinguishant and small droplet size is generally preferable in order to increase the surface area presented to the fire for a given amount of extinguishant as long as droplet volume is sufficient for significant evaporation to occur while still allowing the droplets to be an effective vehicle for the chemicals in the extinguishant. Also, it has been found that a somewhat smaller droplet size is more effective on oil or grease fires than for other fuels.

However, smaller droplets also have increased aerodynamic drag with less accelerated mass and thus small droplets can only be sprayed over a reduced range before droplet momentum is lost (about two to seven feet for suitably small droplets which then become substantially stationary in the horizontal direction while being accelerated by gravity but lifted or suspended somewhat by rising convection currents from the fire; slowly settling over the fire as the droplets agglomerate due to contact with each other to increase in volume somewhat in excess of the rate that water is evaporated therefrom). Further, over increasing distance from the nozzle, some droplets will come in contact with each other and form larger droplets while evaporation will tend to diminish droplet size with increasing distance from the nozzle. The mass of individual droplets also affects the spray pattern and range as the droplets are accelerated by gravity. That is, the spray pattern will tend to spread less as horizontal momentum is lost due to aerodynamic drag and acceleration due to gravity increases. Further, the mechanics of the spray droplet behavior is further complicated by the viscosity of the liquid extinguishant as will be discussed in greater detail below.

For example, a nozzle orifice having an internal diameter of about 0.020 inches has been found to be nearly ideal in droplet size of the viscous liquid extinguishant for oil or grease fires (whereas an internal diameter of about 0.025 inches is preferred for fires with other, ordinary fuels) but provides an effective spray range of only about 2 to 2½ feet which is considered to be less than comfortably distant from the fire. However, such an orifice also provides an initially conical droplet distribution which complements the ability of the apparatus 7 to operate in any orientation. Also, at such a distance the spray pattern width is more narrow than is considered optimal for extinguishing an oil or grease fire in some skillets or other cooking vessels of common size (e.g. twelve inches in diameter); allowing fire to be attenuated in one area thereof while the fire continues in another area and is available to reignite areas where the extinguishant has been applied. That is, a narrow spray pattern may result in the fire being "chased" around the fuel area without effectively extinguishing it. Nevertheless, good results and highly effective extinguishing of fires with contained fuels have been experimentally obtained using such a nozzle and relatively direct application of the extinguishant droplets to the fire; extinguishing an oil or grease fire in approximately two seconds or less.

Thus, as will be discussed in greater detail below, the spray pattern is considered to be of substantial importance to optimal performance of the preferred embodiment of the invention and an elliptical or oval nozzle having the long dimension (A in FIG. 1A) of about 0.055 inches oriented horizontally and a short dimension (B in FIG. 1A) of about 0.020 inches develops a substantially optimum spray pattern and droplet size distribution which will form a substantially stationary (in a horizontal direction) cloud at a range of about two to seven feet from the nozzle from which the droplets can settle into the fire over an area having a transverse dimension of somewhat in excess of one foot (e.g. an area having a diameter of about fourteen inches) while having good lateral coverage for distances of about 2 to 6 feet (e.g. a spread of about 12 inches at a range of about four feet from the nozzle). An effective distribution of extinguishant droplets for a twelve inch diameter cooking vessel is also maintained over a substantial range of orientations using such a preferred nozzle. However, it is to be understood that nozzle dimensions and configuration are less critical for other embodiments and applications of the invention for fixed installations such as ventilation hoods and manufacturing and repair facilities or standard size fire extinguishers and the like where the quantity of available extinguishant may be greater, but the above-described considerations, should still be observed for best performance.

Figure 2:
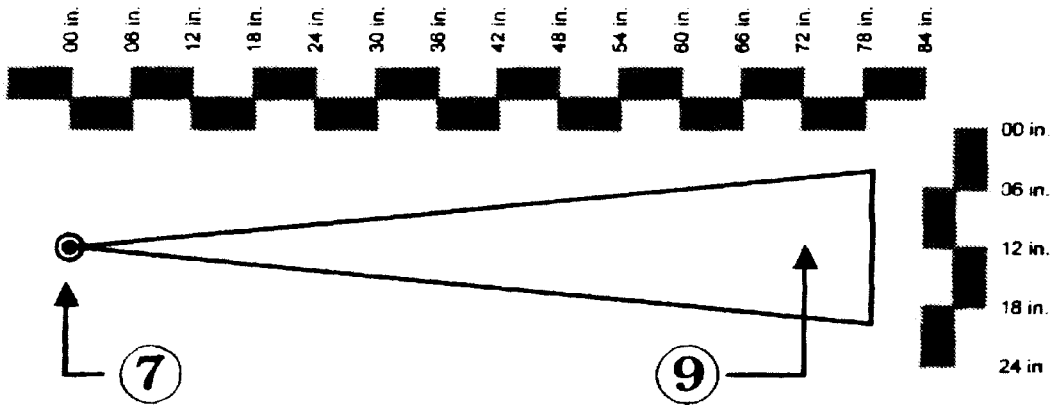
Figure 3:
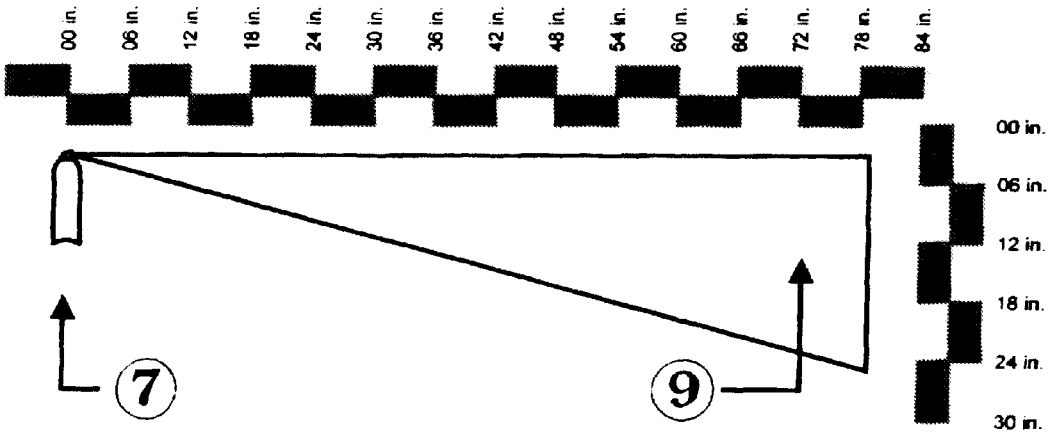
FIG. 3 is a scaled side view of the preferred pattern of extinguishant of FIG. 2.

Referring now to FIG. 2, apparatus 7 and the mist of droplets 9 disseminated from it appear as if seen in a horizontal plane perpendicular to the longitudinal axis of apparatus 7 (e.g. viewed in a vertical direction from above apparatus 7). Similarly. in FIG. 3, the distribution of droplets is as if seen in a vertical plane (viewed in a horizontal direction) parallel to the longitudinal axis of apparatus 7 (and indicating the effects of acceleration of the droplets due to gravity). The pattern of mist disseminated from apparatus 7 is thus seen to be sized to permit a user of average anthropomorphic dimensions to begin to suppress, from a distance of two feet (with a relatively direct application of the extinguishant droplets to the fire) to six feet (by developing a cloud of extinguishant droplets in or immediately above the fire), burning cooking oil contained with a cast iron cooking vessel two inches deep and twelve inches in diameter located atop and heated by a common household range. Those skilled in the art can provide other suitable tailoring of extinguishant mist pattern to other target containments of fuels and anthropomorphic and psychological circumstances (e.g. where a startled user with little or no instruction using apparatus 7 would be likely to direct extinguishant and from what likely location relative to a fire such action would be taken.

Likewise, the preferred portable, hand-held embodiment of the invention provides an apparatus 7 having total weight of less than five pounds and a diameter of less than seventy-five millimeters, an actuator diameter of about seventeen millimeters or greater (for comfortable operation by a finger with an actuation force of less than five pounds); all of which are preferred for successful and intuitive use of the invention by users, including users who may suffer from certain disabilities. Again the simplicity of the basic elements combined in the invention can be tailored to meet virtually any anthropomorphic needs which may be presented. It should also be understood that while a portable, hand-held embodiment is preferred for most flexible use of the invention, the apparatus 7 can be configured as an installation in a fixed location and can be operated by automatic mechanical, electromechanical or any of a wide variety of other means. Such an embodiment considered to fall within the scope of the invention would involve the fixed placement of the apparatus or at least the nozzle portion (and preferably the actuator to avoid initially discharging air from the system) thereof above a potential source of burning fuel and would be actuated by an electromechanical device such as a solenoid, triggered in response to an electrical fire, smoke or temperature detector.

The volume of extinguishant contained within the preferred or other embodiment of the invention preferably includes five distinct components: water, a potassium or aluminum salt or an organic acid, a wetting agent, a film forming agent and a pH balancing agent although it should be understood that one chemical or composition may serve as more than one of these five components. For example, it has been found that aluminum salts of an organic acid may provide additional pH balancing activity in addition to or above that available from potassium salts of an organic acid. (In this regard, it should be appreciated that the formulations of extinguishant in accordance with the invention generally have a pH of 10 or below while known compositions intended for fighting oil or grease fires typically have a pH of 12 or above; sufficient to cause corrosion of the apparatus with which they are applied, greatly compromising reliability, and also tending to cause saponification of the flesh of users which such known extinguishants may come into contact.)

In the extinguishant, water acts as a cooling mechanism, as a carrier for the potassium or aluminum salt of an organic acid and as a carrier for the film forming agent. As the mist of extinguishant enters the flame column above a burning fuel, a portion of the water in the mist is evaporated rapidly. The extinguishant must therefore, contain a volume of water which, after such evaporation, remains sufficient to permit proper carriage of the potassium or aluminum salt and the film forming agent. However, the preferred volume or proportion of water is non-critical and better expressed as that portion of the total volume of extinguishant which is not allocated to other ingredients.

The term wetting agent is used to describe a surfactant or blend of surfactants which both reduces the surface tension of the water present in the extinguishant and causes a foam to be created on the surface of the burning fuel onto which the extinguishant is disseminated. In the preferred embodiments, including variations of the relative concentrations of the above components and combinations thereof, the wetting agent is selected as one which exhibits no human toxicity and is completely devoid of flurosurfactants of any composition. Several acceptable and suitable wetting agents are known to exist and have been tested at relative volumes from 0.4% to 12%. Preferred embodiments of the present invention feature as a wetting agent the liquid disclosed in U.S. Pat. No. 5,585,028 which is hereby fully incorporated by reference. at 1% or greater v/v or a similar formulation known as FEF-5 available from Pyrocool Technologies Inc. of Lynchburg, Va.

Additionally, in addition to the wetting agents described above, a wetting agent developed specifically for use in the present invention comprises about 33% to about 53% W/W of an amphoteric or zwitterionic surfactant, from about 15% to about 35% W/W of a vegetable-derived amphoteric foaming agent and from about 22% to about 42% W/W of a nonionic surfactant. In a preferred embodiment of this particular wetting agent, coco-amino proprionate, cocoamidopropyldimethyl betaine and lauryl amine oxide have been utilized with the resulting wetting agent being present in the extinguishant at about 1% v/v. This wetting agent may also be employed in any application for which the compositions disclosed in the above-incorporated U.S. Pat. No. 5,585,029 is appropriate. The relative volume of wetting agent is considered relatively critical to the practice of the invention since it has been found that concentrations significantly above or below the noted relative volumes degrade the performance of apparatus 7.

In addition to a wetting agent, the extinguishant in accordance with the present invention also includes a film forming agent in very minute concentration approaching 0% which is effective for fires having ordinary fuels but which may be unacceptable with other fuels. Thus, it is preferred that the film forming agent be selected as an aliphatic-based polyurethane emulsion which contains neither isocyanate monomers nor preservatives of any sort and which is present in the extinguishant at a relative volume of about 0.7%. However concentrations of this particular film-forming agent ranging from 0.02% to 2.0% have proven effective. Another acceptable but costly film-forming agent is dendritic poly(glycerol-succinic acid at a relative concentration of about 1.0%.

In most preferred embodiments of the invention, a separate pH balancing agent need not be added to the other ingredients of the extinguishant described above. However, some ingredients discussed above cause the extinguishant to have a pH deviating significantly from that of water and cause a further inclusion of up to 2% of an additional pH balancing agent selected from the group consisting of Magnesium sulfate, magnesium citrate, sodium sulfate, sodium citrate, citric acid and mixtures thereof. The proportion of additional pH balancing agent is not critical to the successful practice of the invention and will be apparent to those skilled in the art.

In the preferred embodiment, potassium lactate or aluminum lactate is present at about 35% v/v as the potassium or aluminum salt of an organic acid. Other suitable salts of an organic acid include but are not limited to potassium or aluminum acetate, potassium or aluminum formate, potassium or aluminum tartrate, potassium or aluminum citrate, potassium or aluminum sorbate and potassium or aluminum gluconate; any or all of which may be used in any combination and which may have different effects on viscosity of the liquid extinguishant. Concentrations of potassium or aluminum salts of an organic acid as low as 20% v/v and as high as 60% v/v have proven effective.

Other formulations of extinguishant which have been found to be particularly effective are

| | |
|---|---|
| Water | 20.2% |
| Lactic Acid | 27.89% |
| Potassium Hydroxide 45% Liq. | 33.69% |
| Potassium Carbonate 47% Liq. | 7.37% |
| Potassium Bicarbonate | 3.93% |
| Intermediate IXF | 6.93% |
| and | |
| Potassium Lactate (60% conc.) | 61.0% |
| Potassium Carbonate (47% conc.) | 7.6% |
| Potassium Bicarbonate (20% conc.) | 21.5% |
| Intermediate IXF | 6.7%, |
| and | |
| Additional water | 3.2% |

where the intermediate IXF is the fire extinguishing foam formulation known commercially as FEF described in the above-incorporated U.S. Pat. No. 5,585,028 or a similar formulation, preferably "FEF-5", both available from Pyrocool Technologies, Inc. of Lynchburg, Va., to enhance micelle or bubble formation along with the droplets formed by the nozzle/actuator as described above. A fire fighting and cooling composition that is particularly useful for fighting fires involving polar solvents and volatile liquid hydrocarbons includes a combination of non-ionic surfactants, such as amine oxides, organic sulfates or sulfonates, and amphoteric surfactants, such as acylamidoalkylbetaines. However, some variation in the above formulations also provide effective results. For example, the effective range of potassium lactate is 20% -80% and potassium acetate can be substituted for potassium lactate and aluminum salts of an organic acid can be substituted for either or both. The above formulations should also be understood to define a range of proportions of the five components noted above.

The apparatus 7 as described above including the preferred extinguishant compositions also described above is preferably used to fight a fire in which the fuel is contained by orienting the apparatus 7 such that the nozzle is within about six feet of and pointing toward the burning fuel. Thereafter, the dispensing valve is activated causing a directed mist of finely divided droplets of liquid extinguishant to be disseminated toward and above the fuel and/or fire. After a brief initial application of extinguishant from apparatus 7, the extinguishant is then disseminated as a mist at locations where it falls onto the surface of the burning fuel, preferably by repositioning and oscillating the apparatus 7 or at least the nozzle portion thereof and such application continued until extinguishant is exhausted or the fire is fully extinguished and the fuel and adjacent surfaces cooled below the temperature necessary for re-ignition of the fuel. It should be noted that, in the case of fixed installations of the present invention, the positioning of the nozzle(s) can be such that repositioning and oscillating of the nozzle is unnecessary because of consistency of function with the positioning of the nozzle for initial application of extinguishant. For example, a fixed installation may provide for application of extinguishant from a location above and possibly directly over the anticipated location of a fire at a suitable distance to cover and area in excess of the anticipated area of a fire in much the same pattern as a hand held device would apply extinguishant with a substantially horizontal spray. Such a location is possible because there is no need for the nozzle or complete apparatus to be manipulated by a user.

Such a method of use of the present invention, while not critical to the effective use of the invention to quickly extinguish fires is nevertheless considered to the extremely important for other reasons, particularly in comparison with fire extinguishers previously known in the art. Such known fire extinguishing apparatus have had notably short discharge time, ranging up to only about thirty seconds and have employed extinguishants which, for reasons of toxicity, expense and environmental soundness, should be discharged for only the shortest possible interval of time. In contrast, the present invention can be configured to have a longer discharge time of up to three minutes, consistent with the lack of toxicity of the ingredients discussed above and the avoidance of discharge of propellant, as also discussed above. Such longer intervals, particularly in comparison with the very short interval of a few seconds or less needed to initially extinguish flames of the fire, and which safely can and should be dispensed over longer intervals to assure, as fully as possible, that the fuel and surrounding materials have been cooled below the re-ignition temperature.

In view of the foregoing, it is clearly seen that the invention provides a system comprising a combination of apparatus and extinguishant and preferred components of both which provide a fire extinguishing system of greatly increased effectiveness, particularly for fighting fires where the fuel therefor is contained but which can readily be spread by other apparatus and methods of extinguishant application. The invention is particularly effective in rapidly extinguishing flames without tending to spread fuel and/or ignite secondary fires while allowing the non-toxic extinguishant to be applied for a sufficient period to more reliably avoid re-ignition than has heretofore been possible.

In addition to fire-fighting qualities of the present invention and the fire-extinguishing properties of the above formulation which are particularly suitable for use in the home as well as many other environments and applications, it has been found that the fire extinguishing spray also has the quality of resisting electrical discharge and has been applied safely to objects carrying a potential as high as 35,000 volts. Therefore, the invention is effective in fighting oil and grease fueled fires even where very high voltages may be present.

While the invention has been described in terms of a single preferred embodiment, those skilled in the art will recognize that the invention can be practiced with modification within the spirit and scope of the appended claims.

The invention claimed is:

1. Apparatus for fighting a fire wherein fuel for said fire is confined to an area approximating a cooking utensil or food heating surface in size, said apparatus comprising i) a container comprising a rigid outer body, a flexible bladder contained within said rigid outer body, and a charge of gaseous propellant contained in an ullage which exists between said rigid outer body and said flexible bladder, said flexible bladder containing a composition comprising a liquid fire extinguishing composition, comprising a) water, lactic acid, potassium hydroxide 45% liquid, potassium carbonate 47% liquid, and potassium bicarbonate; and b) a foam formulation comprising at least one non-ionic surfactant and at least one amphoteric surfactant to enhance fire extinction and function as a wetting agent, wherein said liquid fire extinguishing composition comprises and has a viscosity determined principally by an at least 20% v/v concentration of one or more potassium or aluminum salts of an organic acid or a combination of potassium or aluminum and an organic acid, said 20% v/v concentration including said potassium hydroxide 45% liquid, potassium carbonate 47% liquid, and potassium bicarbonate, and wherein said liquid fire extinguishing composition is under pressure; and ii) a nozzle capable of spraying droplets of said liquid fire extinguishing composition on an area exceeding said area to which said fuel is confined when sprayed from a range of two to seven feet.

2. The apparatus of claim 1, wherein ingredients in said fire extinguishing composition are present in said composition in the following approximate amounts:

| | |
|---|---|
| water | 20.2% |
| lactic acid | 27.89% |
| potassium hydroxide 45% liquid | 33.69% |
| potassium carbonate 47% liquid | 7.37% |
| potassium bicarbonate | 3.93% |

and a foam formulation comprising at least one non-ionic surfactant and at least one amphoteric surfactant 6.93%.

3. The apparatus as recited in claim 1, wherein said liquid fire extinguishing composition further includes a pH balancing agent.

4. The apparatus as recited in claim 3, wherein said pH balancing agent is selected from the group consisting of magnesium sulfate, magnesium citrate, sodium sulfate, sodium citrate, citric acid and mixtures thereof.

5. The apparatus as recited in claim 1, wherein said liquid fire extinguishing composition has a pH of 10 or less.

6. Apparatus for fighting a fire wherein fuel for said fire is confined to an area approximating a cooking utensil or food heating surface in size, said apparatus comprising i) a container comprising a rigid outer body, a flexible bladder contained within said rigid outer body, and a charge of gaseous propellant contained in an ullage which exists between said rigid outer body and said flexible bladder, said flexible bladder containing a composition comprising a liquid fire extinguishing composition, comprising a) water, lactic acid, potassium hydroxide 45% liquid, potassium carbonate 47% liquid, and potassium bicarbonate; and b) a foam formulation comprising at least one non-ionic surfactant and at least one amphoteric surfactant to enhance fire extinction and function as a wetting agent, wherein said liquid fire extinguishing composition comprises and has a viscosity determined principally by an at least 20% v/v concentration of one or more potassium or aluminum salts of an organic acid or a combination of potassium or aluminum and an organic acid, said 20% v/v concentration including said potassium hydroxide 45% liquid, potassium carbonate 47% liquid, and potassium bicarbonate, and wherein said liquid fire extinguishing composition is under pressure; and ii) a nozzle capable of forming a distribution of droplets of said liquid fire extinguishing composition which is substantially stationary in a horizontal direction in and above an area exceeding said area to which said fuel is confined.

7. Apparatus for fighting a fire wherein fuel for said fire is confined to an area approximating a cooking utensil or food heating surface in size, said apparatus comprising i) a container comprising a rigid outer body, a flexible bladder contained within said rigid outer body, and a charge of gaseous propellant contained in an ullage which exists between said rigid outer body and said flexible bladder, said flexible bladder containing a composition comprising a liquid fire extinguishing composition, comprising a) water, potassium bicarbonate, potassium carbonate, and potassium lactate; and b) a foam formulation comprising at least one non-ionic surfactant and at least one amphoteric surfactant to enhance fire extinction and function as a wetting agent;

wherein said liquid fire extinguishing composition comprises and has a viscosity determined principally by an at least 20% v/v concentration of one or more potassium or aluminum salts of an organic acid or a combination of potassium or aluminum and an organic acid, said 20% v/v concentration including said potassium bicarbonate, potassium carbonate, and potassium lactate, and wherein said fire extinguishing composition is under pressure; and ii) a nozzle capable of spraying droplets of said liquid fire extinguishing composition on an area exceeding said area to which said fuel is confined when sprayed from a range of two to seven feet.

8. The apparatus of claim 6, wherein ingredients in said fire extinguishing composition are present in said composition in the following approximate amounts:

| | |
|---|---|
| water | 20.2% |
| lactic acid | 27.89% |
| potassium hydroxide 45% liquid | 33.69% |
| potassium carbonate 47% liquid | 7.37% |
| potassium bicarbonate | 3.93% |

and a foam formulation comprising at least one non-ionic surfactant and at least one amphoteric surfactant 6.93%.

9. The apparatus as recited in claim 6, wherein said liquid fire extinguishing composition further includes a pH balancing agent.

10. The apparatus as recited in claim 9, wherein said pH balancing agent is selected from the group consisting of magnesium sulfate, magnesium citrate, sodium sulfate, sodium citrate, citric acid and mixtures thereof.

11. The apparatus as recited in claim 6, wherein said liquid fire extinguishing composition has a pH of 10 or less.

12. The apparatus of claim 7, wherein ingredients in said fire extinguishing composition are present in said composition in the following approximate amounts:

| | |
|---|---|
| potassium lactate (60%) | 61% |
| potassium carbonate (47%) | 7.6% |
| potassium bicarbonate (20%) | 21.5% |
| water | 3.2%. |

and a foam formulation comprising at least one non-ionic surfactant and at least one amphoteric surfactant 6.7%.

13. The apparatus as recited in claim 7, wherein said liquid fire extinguishing composition further includes a pH balancing agent.

14. The apparatus as recited in claim 13, wherein said pH balancing agent is selected from the group consisting of magnesium sulfate, magnesium citrate, sodium sulfate, sodium citrate, citric acid and mixtures thereof.

15. The apparatus as recited in claim 7, wherein said liquid fire extinguishing composition has a pH of 10 or less.

* * * * *